US009163528B2

(12) United States Patent
Moser

(10) Patent No.: US 9,163,528 B2
(45) Date of Patent: Oct. 20, 2015

(54) CONTROL SYSTEM AND METHOD FOR BIOMASS POWER PLANT

(71) Applicant: MIDDLEBURY COLLEGE, Middlebury, VT (US)

(72) Inventor: Michael William Moser, Ticonderoga, NY (US)

(73) Assignee: MIDDLEBURY COLLEGE, Middlebury, VT (US)

( * ) Notice: Subject to any disclaimer, the term of this patent is extended or adjusted under 35 U.S.C. 154(b) by 419 days.

(21) Appl. No.: 13/774,182

(22) Filed: Feb. 22, 2013

(65) Prior Publication Data

US 2014/0208748 A1 Jul. 31, 2014

Related U.S. Application Data

(60) Provisional application No. 61/758,133, filed on Jan. 29, 2013.

(51) Int. Cl.
*F01K 11/00* (2006.01)
*F01K 13/02* (2006.01)

(52) U.S. Cl.
CPC ..... *F01K 13/02* (2013.01)

(58) Field of Classification Search
CPC ..... F01K 13/02
USPC ..... 60/272–324, 643–681
See application file for complete search history.

(56) References Cited

U.S. PATENT DOCUMENTS 4,043,742 A 8/1977 Egan et al.
4,454,827 A 6/1984 Smith et al.
4,492,085 A * 1/1985 Stahl et al. ..... 60/649
4,532,873 A 8/1985 Rivers et al.
4,936,098 A * 6/1990 Nakhamkin ..... 60/652
4,983,853 A 1/1991 Davall et al.
5,207,176 A 5/1993 Morhard et al.
5,245,196 A 9/1993 Cabalfin
5,285,629 A * 2/1994 Gounder ..... 60/39.12
5,424,554 A 6/1995 Marran et al.
5,797,332 A 8/1998 Keller et al.
6,050,807 A 4/2000 Baek
6,129,284 A 10/2000 Adams et al.
6,141,601 A 10/2000 Baek
6,485,296 B1 11/2002 Bender et al.
8,087,926 B2 * 1/2012 Patrick et al. ..... 431/8
8,109,758 B2 2/2012 Kim
2005/0183642 A1 * 8/2005 Basic, Sr. ..... 110/224
2006/0010868 A1 * 1/2006 Smith ..... 60/645
2006/0172238 A1 8/2006 Cook
2010/0151397 A1 6/2010 Farrell et al.
2010/0280665 A1 11/2010 Fildes et al.
2011/0209647 A1 9/2011 Mitchell et al.
2012/0085028 A1 4/2012 Leininger

* cited by examiner

*Primary Examiner* — Jesse Bogue
(74) *Attorney, Agent, or Firm* — Pillsbury Winthrop Shaw Pittman, LLP

(57) ABSTRACT

A system and a method for controlling operation of a power plant system. The system has at least a gasifier, a boiler, an induced draft fan, and a baghouse. A controller in communication with the system is configured to implement a first stage and/or a second stage sequences after detecting loss of flame in the boiler using a temperature measurement device. The method includes automatically bypassing the baghouse and controlled (e.g., decreasing) the speed of the induced draft fan in the system to relight the boiler. The input feed to the gasifier can be limited and devices operated for a predetermined amount of time before reigniting the boiler.

10 Claims, 7 Drawing Sheets

CONTROL SYSTEM AND METHOD FOR BIOMASS POWER PLANT

RELATED APPLICATION(S)

This application claims priority to U.S. Provisional Patent Application No. 61/758,133, filed Jan. 29, 2013, which is hereby incorporated by reference in its entirety.

BACKGROUND

1. Field

The present invention is generally related to a control system and method for a biomass plant.

2. Description of Related Art

Power plant systems can utilize a boiler and/or gasifier for burning fuel. It is known that boilers typically have flame safety features to detect flames or a lack of flame. Upon detection of loss of flame, the fuel to the boiler can be turned off as a safety measure.

However, in combination gasifier-boiler systems, such as those that use wood as biomass fuel, safety features are not typically present (e.g., such as in a system by Chiptec®). The boiler system flame can go out, e.g., because of unstable conditions in the gasifier, but the gasifier could continue to produce gas generated from wood chips. This unburned gas can continue to generate and accumulate in the boiler exhaust system, including a bag house. If conditions are sufficient to do so, a fire could ignite in the bag house.

SUMMARY

It is an aspect of this disclosure to provide a method for controlling operation of a power plant system. The power plant system includes at least a gasifier, a boiler, an induced draft fan, and a baghouse. The gasifier is configured to receive input feed including biomass as fuel to produce exhaust gas. The boiler has a flame for igniting the exhaust gas received from the gasifier and for providing power. A measurement device is associated with the boiler and is configured to measure a temperature of the flame of the boiler and to determine loss of flame based on the temperature. The baghouse is configured to receive exhaust gas from at least the boiler to remove particulates therefrom. The induced draft fan is configured to control the production rate of energy and to run at a predetermined speed to draw filtered exhaust gas from the baghouse for output via an exhaust system. A controller is in communication with the power plant system and is configured to implement the method after detecting loss of flame in the boiler using the measurement device. The method includes:

implementing a first stage sequence in response to the detecting the loss of flame in the boiler including:

automatically bypassing the baghouse;

automatically decreasing the speed of the induced draft fan; and determining if the flame of the boiler is reestablished.

Another aspect provides a power plant system including a gasifier configured to receive input feed including biomass as fuel to produce exhaust gas; a boiler having a flame for igniting the exhaust gas received from the gasifier and for providing power; a measurement device associated therewith configured to measure a temperature of the flame of the boiler and to determine loss of flame based on the temperature; a baghouse configured to receive exhaust gas from at least the boiler to remove particulates therefrom; an induced draft fan configured to run at a predetermined speed to draw filtered exhaust gas from the baghouse for output via an exhaust system, and a controller in communication with the power plant system, wherein, after detecting loss of flame in the boiler using the measurement device, the controller is configured to automatically bypass the baghouse and automatically decrease the speed of the induced draft fan.

Other aspects, features, and advantages of the present invention will become apparent from the following detailed description, the accompanying drawings, and the appended claims.

DETAILED DESCRIPTION OF THE PREFERRED EMBODIMENT(S)

The herein disclosed system and method are configured to provide safety system control logic upon detection of a loss of flame in a boiler that is working in cooperation with a gasifier. This disclosure refers to a control system and method implemented after boiler flame loss measurement or detection, also referred to herein as "loss of flame" or "flame out," so that automatic corrective action is taken to reignite the flame. The induced draft fan of the system is controlled in an attempt to relight the burner while insuring that the baghouse is bypassed in order to reduce and/or eliminate hazardous conditions (e.g., fire). If needed, the controls can be reset and an operator can intervene.

Referring now more particularly to the drawings, shown are devices and systems that are part of a power plant system. One of ordinary skill in the art should understand that the power plant system is not limited merely to the devices shown in the Figures, but, rather, understand that additional devices, systems, valves, sensors, and the like may be included in or with the power plant system 100.

Figure 1:
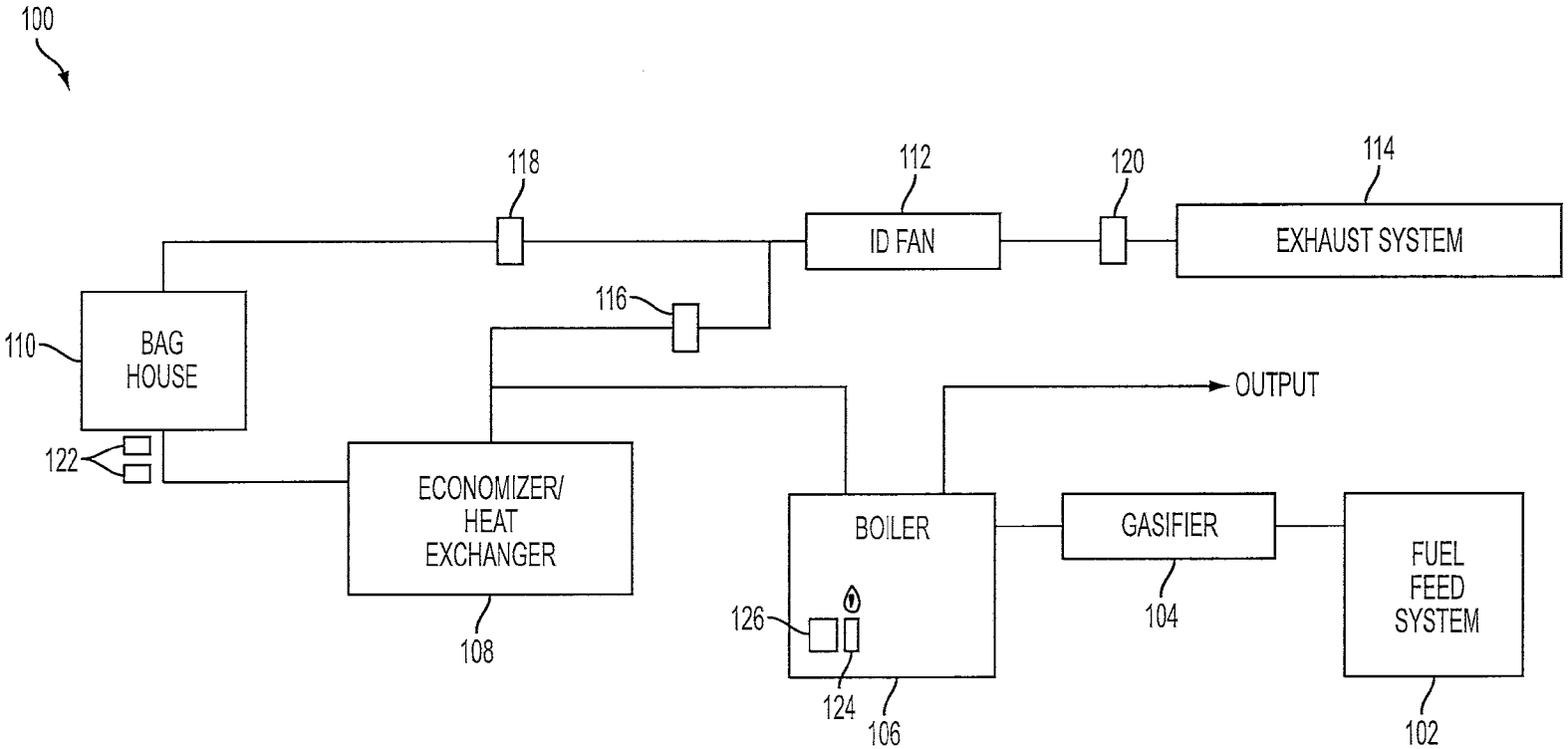
FIG. 1 illustrates devices in a power plant system in accordance with an embodiment of the present disclosure.

The power plant system 100 is configured to produce and supply power, e.g., steam, via its output to another system. The power plant system as shown in FIG. 1 includes at least a gasifier 104, a boiler 106, an induced draft fan 112, and a baghouse 110. The power plant system 100 also includes a fuel feed system 102, a heat exchanger 108 (e.g., economizer), valves 116 and 118 and/or dampers, and an exhaust system 114.

The fuel feed system 102 is configured to feed biomass as fuel input to the gasifier 104 for burning. The fuel feed system 102 can feed biomass fuel into the gasifier 104 at a controlled rate. In accordance with one embodiment, the fuel feed system feeds wood or wood chips to the gasifier 104.

The gasifier 104 is configured to receive input feed including biomass as fuel to produce exhaust gas. The boiler 106 is close coupled to the gasifier 104. The gasifier and boiler work as a gasification system to transform burned biomass fuel (e.g., wood) into combustible gases and ash and into gas or steam as output for providing energy. As generally known in the art, the gasifier 104 includes a flame, that can be in the form of an incinerator or kiln, for example, located therein that receives the biomass fed by the fuel feed system 102. As the biomass (e.g., wood) is burned or gasified, output gas is created. Combustion air is pulled through the gasifier by fans or other airflow devices. The gasifier 104 can also have a device for directing air flow of its exhaust output gases to the boiler 106. An air flow valve, e.g., an adjustable air valve, can also be provided for controlling flow of oxygen or air into the gasifier 104 and/or boiler 106 for operation.

The boiler 106 has a flame 124 for igniting the output exhaust gas received from the gasifier 104. The exhaust gas from the gasifier 104 is pulled into the boiler and burned. The boiler 106 acts as a generator by applying heat energy to water and using the produced output in the form of gas or steam as a power source. The combination of burning biomass plus gasifying medium (e.g., steam) plus heat (plus oxygen/air) further produces residual/solid (ash) and (flue) gases for output via an exhaust system 114. Flue gas is the gas exiting to the atmosphere, typically via a flue, which is a pipe or channel for conveying exhaust gases from a boiler or steam generator, for example.

In accordance with an embodiment, a Chiptec® Wood Energy System is used as for biomass gasification with the power plant system 100.

In accordance with an embodiment, a measurement device 126 is associated with the boiler 106 that is configured to measure a temperature of the flame 124 of the boiler 106. This temperature measurement device 126 is configured to measure the temperature of the flame 124 of the boiler 106 that is connected to the gasifier 104 and to determine a loss of flame 126 based on the temperature. Low flame temperature measurements can indicate poor combustion and increased emissions within the gasifier-boiler combination. Accordingly, the measurement device 126 is calibrated such that it can detect loss of flame conditions via temperature measurements of the flame 124. The temperature at and/or below at which it indicates a loss of flame can be predetermined and/or adjusted to a set temperature. As described further below, the measurement device 126 sends its readings and information to a controller to control parts of system, e.g., valves 116 and 118 to bypass the baghouse 110, induced draft fan 112, and feed system 102 to reduce control of flow of gases through the system as well as vary the rate of transporting exhaust gases in response to the detection of flame out condition.

In accordance with one embodiment, the measurement device 126 used with the boiler 106 is a Mikron Infrared Inc.-type flame temperature measurement instrument. For example, this instrument can be mounted on a flame sight tube of the boiler 126. However, any other temperature measurement device or sensor can be used with the boiler 106 to determine the loss of its flame.

A heat exchanger 108 in the form of an economizer is also provided in the power plant system 100. The heat exchanger 108 recovers heat from the exhaust gases output from the boiler before entering the baghouse 110. The heat exchanger 108 can be water-cooled, for example.

The baghouse 110 is configured to receive exhaust flue gas from at least the boiler 106 by way of the heat exchanger 108 to remove particulates therefrom. The baghouse 110 acts as part of an air pollution and emissions control system that substantially reduces and/or removes particulate matter out of the air or flue gases received to control emission of air pollutants. As generally understood by one of ordinary skill in the art, dust or ash-laden gas or air enters the baghouse 110 and is directed into and through the baghouse 110. The gas is drawn through the bags, either on the inside (e.g., using a fan or air flow device) or the outside (e.g., using ID fan), or both.

The configuration and/or type of baghouse system used with the power plant system 100 are not limiting. For example, the baghouse system can include one or more than one bag that are long and cylindrical bags (e.g., tubes) and made of woven or nonwoven (e.g., felted or membrane) fabric (s) as a filter medium for capturing ash or dust from the exhaust flue gases. Further, any type or combination of baghouses can be used (e.g., shaker, reverse air, pulse or reversed jet, or a combination thereof), and should not be limited.

One or more valves 122 can be associated with the baghouse 110. Such valves can be associated with an ash removal system, for example, in which the valves 122 are configured to (selectively) open to allow removal of collected ash from the baghouse 110. The baghouse 110 can also include a cleaning air pulse system configured to input air into the bag(s).

Filtered exhaust flue gases from the baghouse 110 are output to induced draft fan(s) 112, also noted throughout this disclosure as "ID fan". Although throughout this disclosure reference is made to an ID fan, it should be understood that such reference refers to one or more than one ID fan, and/or the system associated with operating the ID fan, and thus is not limiting. The induced draft fan(s) 112 is configured to control the production (rate) of energy, e.g., steam, of the power plant system 100. The induced draft fan(s) 112 is configured to run at a predetermined speed to draw the filtered exhaust gas from the baghouse 110 for output via the exhaust system 114, and is typically positioned therebetween. ID fan 112 is configured for varying speeds to variably control pressure throughout the system 100 and to control flow of exhaust gases through the system 100, e.g., from the baghouse to remove particulates from the exhaust and produce clean(er) exhaust air. The flow rate of air as moved by ID fan 112 can be adjusted. In an embodiment described further below, the speed of the ID fan 112 is varied (e.g., reduced) by controller in order to reduce flow of exhaust gases through the system upon detection of a flame out condition in the boiler 106.

A damper 118 is provided between the baghouse 110 and ID fan 112 to allow or prevent movement of filtered exhaust gas to ID fan 114. Another damper 116 is provided between the ID fan 112 and heat exchanger 108.

The exhaust system 114 can include stacks for directing filtered exhaust gas from the ID fan 112 into the atmosphere. Stack oxygen (O2) controllers may be included therewith. One or more valves 120 or dampers may optionally be included between the ID fan 112 and exhaust system 114 to assist in controlling or limiting flow of the exhaust gas into the stacks of the exhaust system before exiting into the atmosphere.

A controller is in communication with the power plant system 100 and is configured to implement the herein disclosed method after detecting loss of flame in the boiler 106 using the measurement device 126. The controller can be connected to measurement devices and/or sensors (wirelessly or non-wirelessly) throughout the system 100 for monitoring and controlling the devices. As provided herein, in accordance with an embodiment, the controller is capable of being programmed to monitor and control the devices in response to a flame out condition. The controller can be associated with an existing system or program that is alterable.

FIG, 2 illustrates the devices of the power plant system 100 of FIG. 1 in normal operation in accordance with an embodiment. "Normal operation" of system 100 refers to operating the system 100 with baghouse 110 in service, ID fan 112 operating at a selected rate to control production of energy (e.g., steam), and the fuel being fed to the gasifier 104/boiler 106. The method 200 for controlling operation of the power plant system 100 is shown in FIG. 1 Operation of the power plant system 100 is started at 202 and the system is monitored at 204. As the system runs, the controller associated with the power plant system 100 is configured to monitor, among other devices, the gasifier 104, boiler 106, flame temperature measurement device 126, ID fan 112, and exhaust system 114 (e.g., stack O2 controllers). The step of monitoring at 204 can include ensuring that the boiler master, ID fan speed, gasifier level, and stack O2 controllers are in automatic mode, for example.

In accordance with an embodiment, under normal operation, the boiler master output, HI OUT, is set to or between approximately 50% to approximately 100%. In one embodiment, HI OUT is set at approximately 60%. In an embodiment, the ID fan 112 speed is set to or between approximately 25% to approximately 100% under normal operation. In one embodiment, the speed of the ID fan 112 is set at approximately 60%. Of course, it should be understood by one of ordinary skill in the art that these examples are not limiting, and that operation of the power plant system 100 may be and can be varied during normal operation and/or to adjust operation (to an improved normal operation) so that a desired output of energy is obtained using the power plant system 100.

Also during normal operation, baghouse 100 and its bag cleaning system and ash removal system (e.g., valves 122) are confirmed as being in service. Valves 122 are provided for ash collection and removal from baghouse 110. One of ordinary skill in the art understands that, during normal operation, opening and closing of valves 122 is controlled to remove collected ash and/or embers. For example, a top valve 122 can remain in an open position during normal operation, while a bottom valve 122 is closed. Ash can thus fall below and between the valves 122. To remove ash, the top valve 122 closes, and the bottom valve 122 closes, allowing for ash to fall out. However, the use of valves 122 is exemplary and other systems for removing ash may be associated with baghouse 110.

Figure 2:
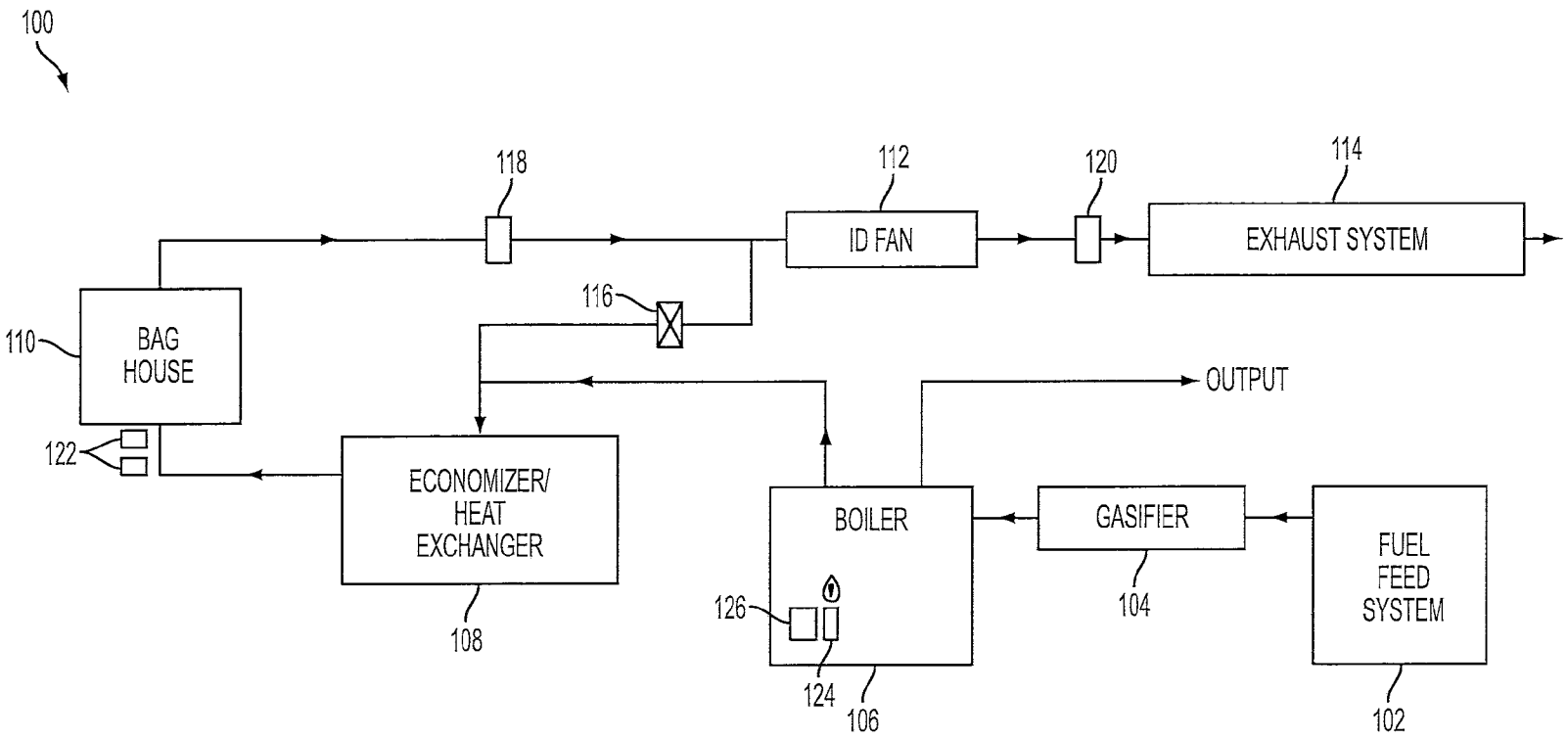
FIG. 2 illustrates the devices of the power plant system of FIG. 1 in operation in accordance with an embodiment.

A signal generator is connected to the flame temperature measurement device 126 (e.g., analog input) associated with the gasifier 104-boiler 106, and its reading is confirmed. Damper 118 is open, while damper 116 remains closed. During normal operation of the power plant system 100, as shown in FIG. 2, the fuel feed system 102 is designed to feed biomass (e.g., wood) to the gasifier 104-boiler 106. Heat is removed from the output exhaust gas from boiler by the heat exchanger 108, which is water cooled. Baghouse 110 receives the cooler, combustible exhaust gases from the boiler 106 (after passing through heat exchanger 108). Damper 118 and ID fan 112 are used to assist in the control of the flow of air from baghouse 110 through valve 120 and out exhaust system 114.

Under normal operation, the flame temperature for boilers can be at or between approximately 1700 to approximately 2000 degrees Fahrenheit (F), for example. Based on operating data of known boiler devices, temperatures measured at or below approximately 1000 degrees Fahrenheit (F) to approximately 1500 degrees F., for example, can indicate a loss of flame condition in the boiler 106. As previously noted, if the flame burns out, accumulation of non-burned gas generated by the gasifier 104 can go into the baghouse 110, and ash or embers can light and cause fire or other hazards. Accordingly, the method 200 further includes steps for automatic implementation after detecting loss of flame in the boiler using the measurement device 126, in order reignite the flame 124.

Figure 3:
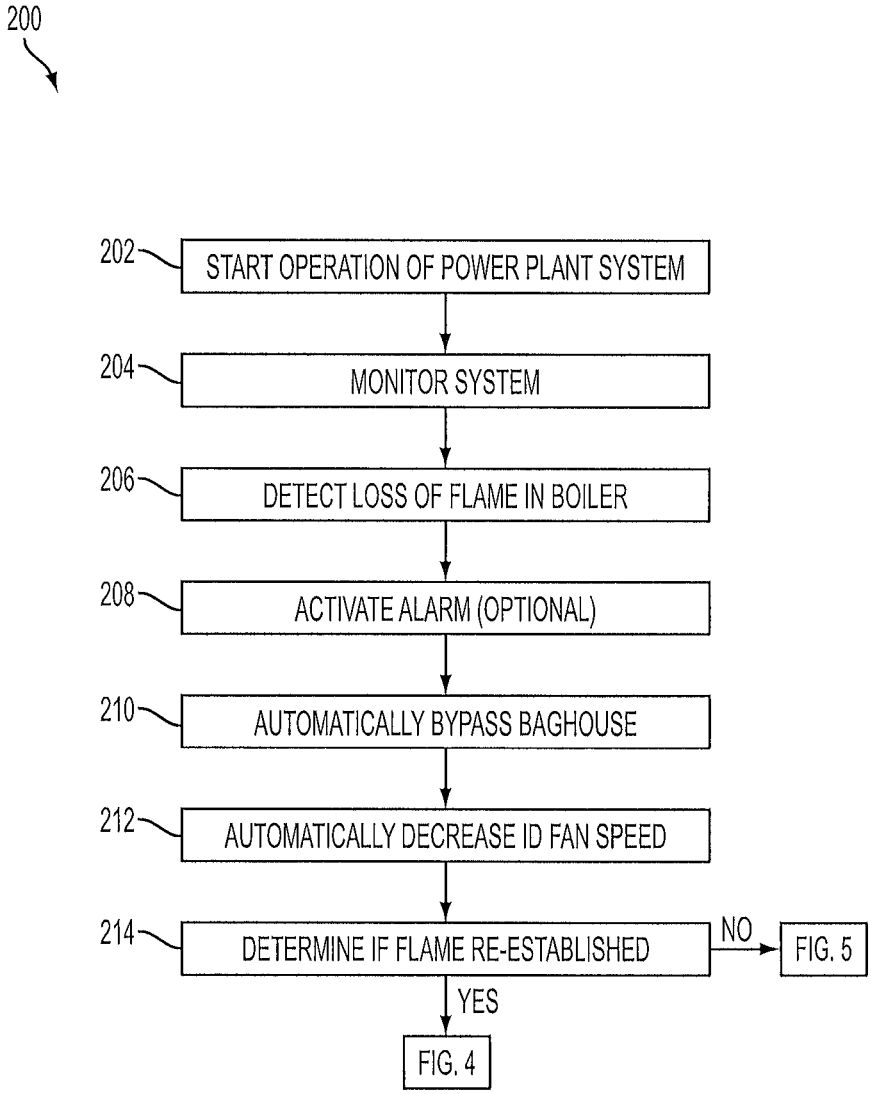
FIG. 3 is a flow chart of a method for controlling operation of a power plant system, including a first stage implementation, in accordance with an embodiment.

As shown in FIG. 3, a loss of flame in the boiler 106 can be detected at 206. In one embodiment, the flame temperature measurement device 126 is configured to indicate a loss of flame in the boiler upon sensing that the temperature is below approximately 1400 degrees F. In another embodiment, the flame temperature measurement device 126 is configured to indicate a loss of flame in the boiler upon sensing that the temperature is below approximately 1200 degrees F. However, the set temperature used to determine a flame loss can be any set temperature, including, but not limited to, the above-noted 1000-5000 degrees F. A first stage sequence is automatically implemented by the controller in response to the detecting the loss of flame in the boiler, i.e., upon detecting that the sensed temperature is at and/or below the predetermined temperature set to measure flame loss. Optionally, the method includes activating or triggering an alarm to indicate the detection of the loss of flame in the boiler at 208. The alarm can be an audible and/or visual alarm. In an embodiment, the optional alarm is used to annunciate the initiation of the first stage sequence.

Figure 6:
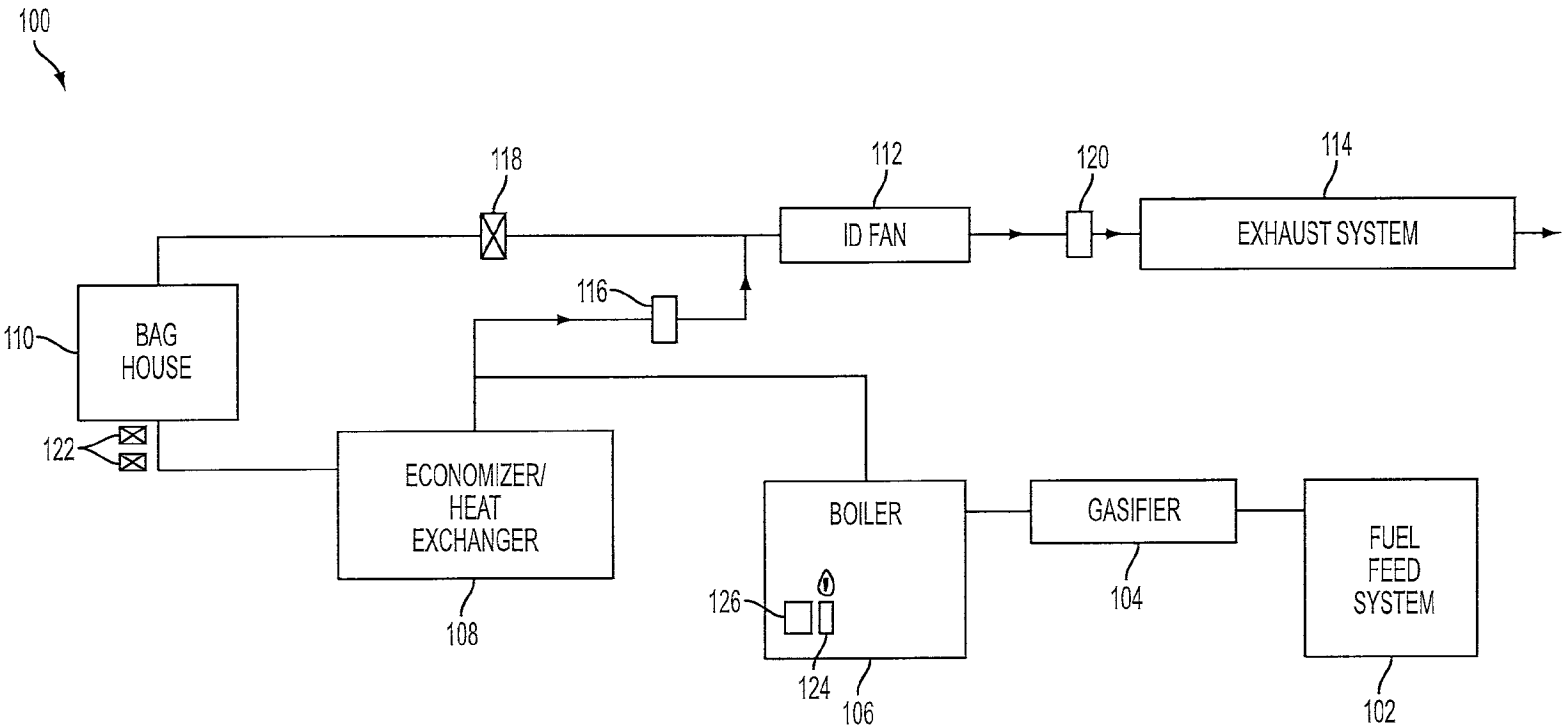
FIG. 6 illustrates the devices of the power plant system in FIG. 1 in operation after detection of loss of flame in the boiler in accordance with an embodiment.
Figure 7:
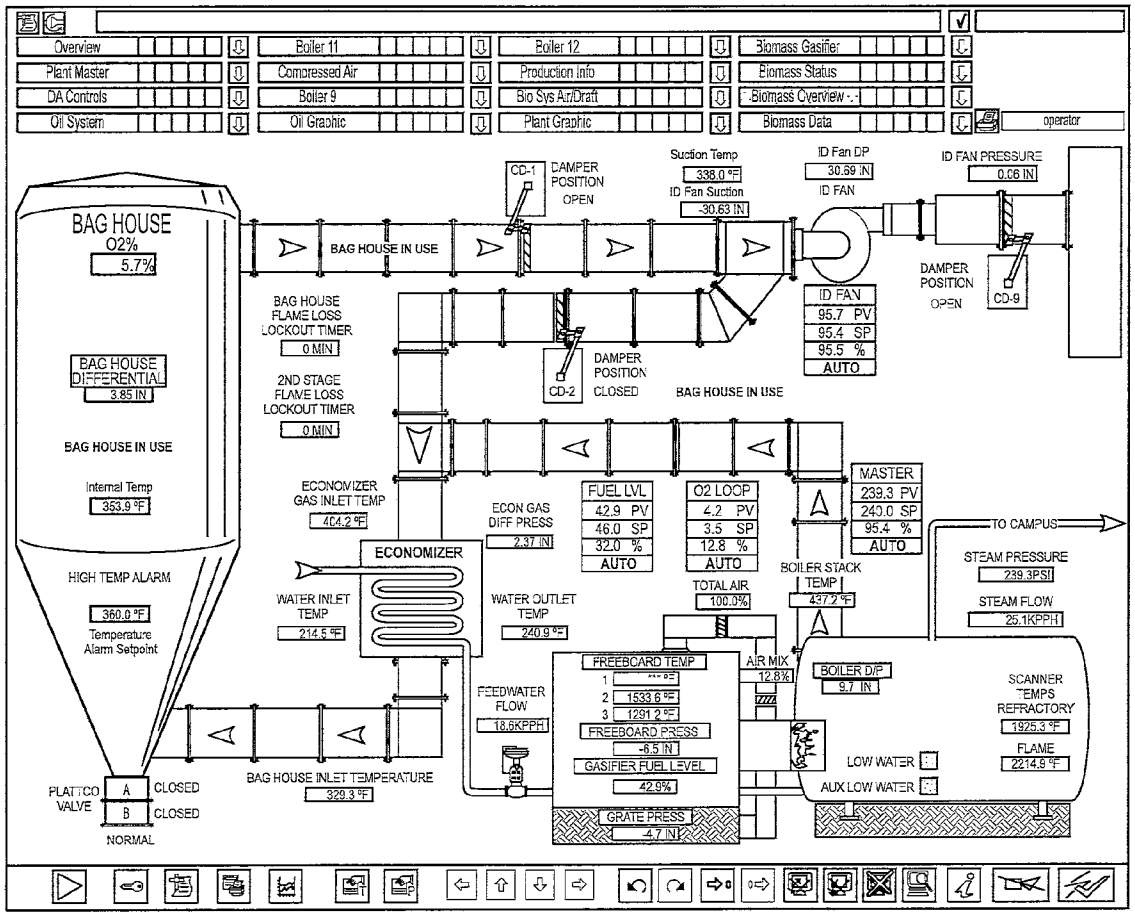
FIG. 7 is an exemplary embodiment of a screen shot associated with a controller associated with the power plant system of FIG. 1.

The first stage sequence includes automatically bypassing the baghouse 110, shown at 210 and automatically decreasing the speed of the induced draft fan 112, as shown at 212. For example, input to the baghouse 110 from at least the boiler 106 is limited. Also, the baghouse 110 output is limited via the ID fan 112 by opening damper 116 and closing damper 118. The dampers 116 and 118 can remain in these bypass positions until flame is reestablished. Accordingly, as shown in FIG. 6, the ID fan 112 is configured to draw exhaust gas from at least the boiler 106 through damper 116, and purge the power plant system 110. Also, automatically bypassing the baghouse 110 can further include inhibiting and locking the bag cleaning air pulse system in inhibit mode. Further, the bag house ash removal cycle system can be immediately inhibited and locked out in inhibit mode. Valves 122, for example, are moved to a closed position and configured to remain closed.

In an embodiment, the ID fan 112 speed automatically decreases to approximately half of its current operating speed, but not below approximately 25% total speed. This action, i.e., of slowing down the operating speed of the ID fan 112, is an attempt to automatically relight the burner. That is, a slower speed ID fan 112 slows the capacity of the power plant system 100 and can cause the burner or gas to automatically re-light. In one embodiment, the operator can decrease or increase the ID fan speed 112 from its half speed at the control panel. In one embodiment, the ID fan 112 can remain at the lower or decreased speed for a predetermined period of time.

At 214, it is determined if the flame is reestablished in the boiler 106. For example, in one embodiment, flame 124 is considered established when the flame temperature reading from measurement device 126 results in a reading at least above >1700 degrees F. In another embodiment, flame 124 is considered established when the flame temperature reading from measurement device 126 results in a reading at least above >1900 degrees F. However, the temperature used to determine an established flame can be set any temperature, including, but not limited to, the above-noted 1700-2000 degrees F. The reading at which the flame is determined as established can be based on the predetermined set temperature at which flame is determined as lost, e.g., above a temperature selected from a range at or between approximately 1000 to approximately 1500 degrees F.

Figure 4:
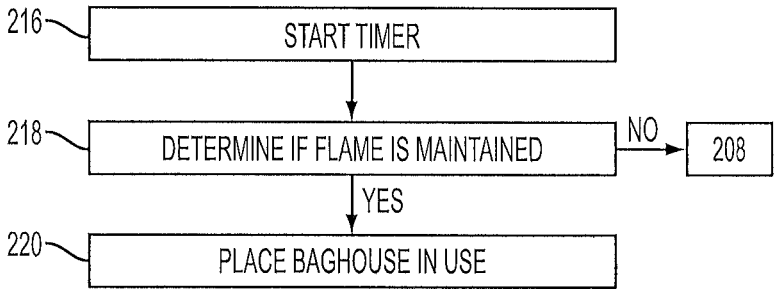
FIG. 4 is a flow chart of additional steps of the first stage implementation of the method of FIG. 3 in accordance with an embodiment.
Figure 8:
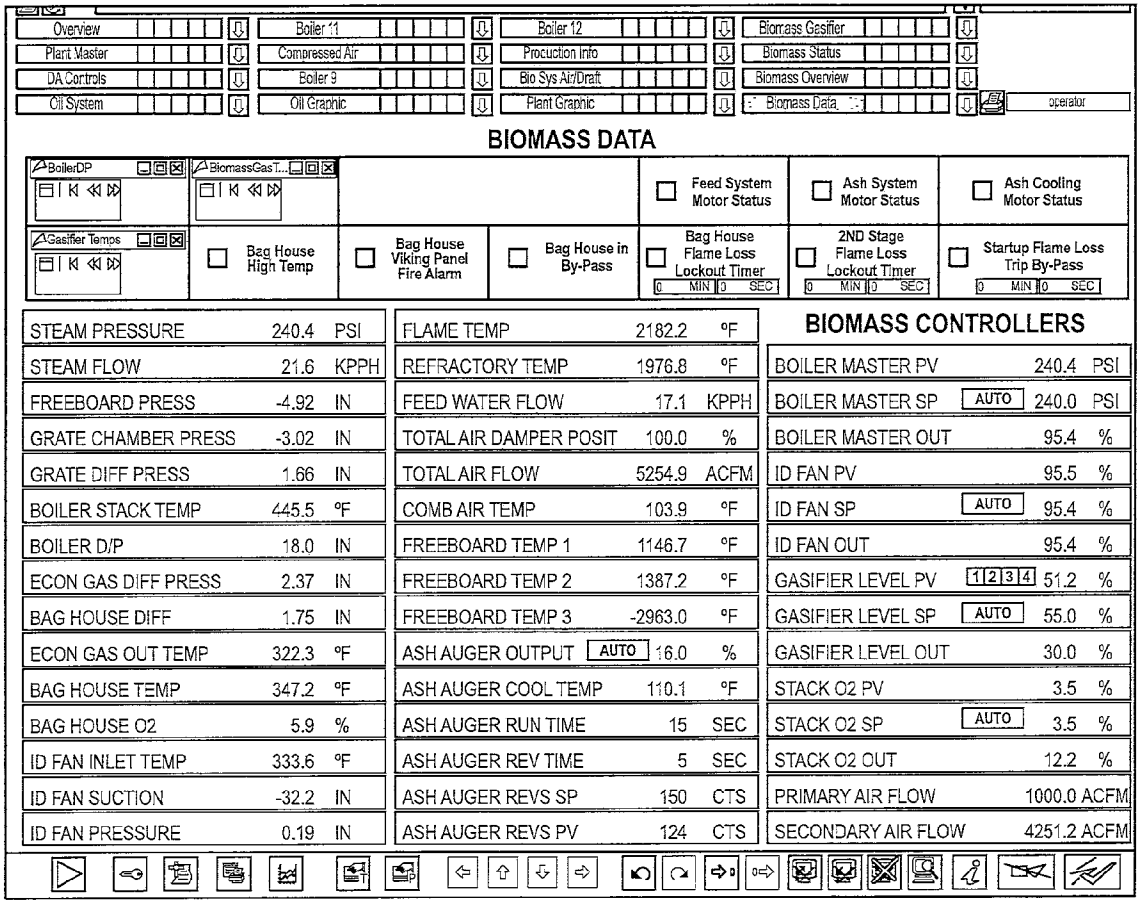
FIG. 8 is an exemplary embodiment of another screen shot associated with a controller associated with the power plant system of FIG. 1.

If YES at 214, then, as shown in FIG. 4, a timer is started at 216. In accordance with an embodiment, the baghouse 110 and its cleaning air pulse and ash removal systems and ID fan 112 are not placed back into full service until a flame has been established in boiler 106 for a predetermined period of time. In accordance with one embodiment, the predetermined period of time is at least approximately 15 minutes. The timer can be associated with a display on the control system, for example, indicating the time remaining until the baghouse 110 and its systems can be placed in service. This timer can be viewed on the exemplary screen shot of FIG. 8, for example, labeled as BAG HOUSE FLAME LOSS LOCKOUT TIMER. In an embodiment, an indicator is associated with the timer to indicate its status. For example, the indicator may display red when counting down the predetermined (e.g., 15 minute) lockout period, and green when the period is complete.

After the timer is complete, it is then determined if the flame is maintained during the predetermined period of time at 218 (e.g., if the reading of the flame temperature measurement device 126 has a continued reading at and/or above the predetermined set temperature used for detecting flame loss). If YES, then the baghouse 110 and ID fan 112 and related systems are placed in use at 220 for normal operation of the power plant system 100, e.g., the bypass of the baghouse 110 is removed by opening damper 118 and closing damper 116, and speed of ID fan 112 is increased. The economizer is thus placed in use. Also, the bag cleaning air pulse system of the baghouse 110 is started, with the ash removal system configured to automatically start when bag cleaning air pulse system starts. Valves 112 can be opened, as needed.

In accordance with one embodiment, before the baghouse 110, ID fan 112, etc. of the power plant system 100 are placed in use for normal operation, the system 100 is purged. A signal may optionally be used to indicate that purging is complete. In an embodiment, the system 100 may be automatically purged upon a positive reading at 218. In another embodiment, an operator may intervene to purge the system 100. The purging of the system 100 may be optional and performed at an operator's discretion, for example.

In accordance with an embodiment, a log can be kept indicating the duration and reason the bag house was bypassed.

If NO at 218, i.e., if the flame is lost (e.g., temperature is measured by measurement device 126 to be <1400 degrees F. (or another predetermined set temperature that indicates flame loss)) during predetermined time/lockout period, the steps 208-214 can be reinitiated. If the flame continues to be detected or determined as lost during the predetermined period of time, operator intervention may be required in order to initiate an emergency stop situation and bypass the method 200.

Figure 5:
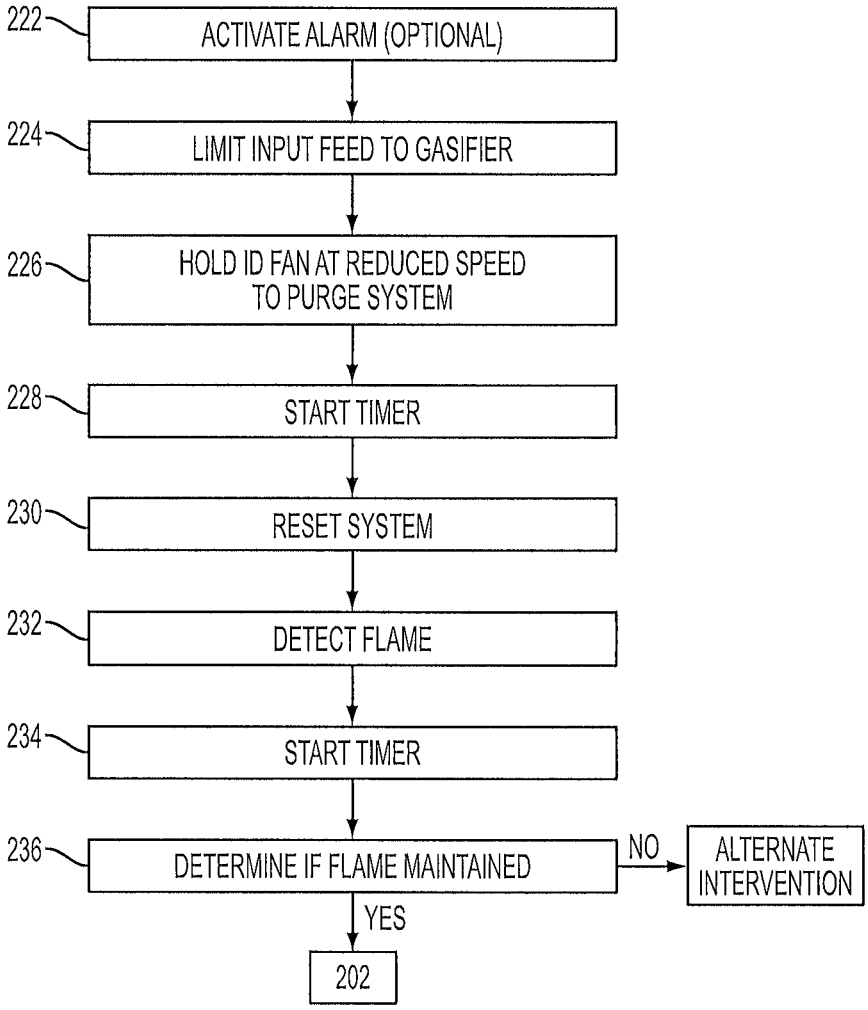
FIG. 5 is a flow chart of a second stage implementation of the method of FIG. 3.

Referring back to FIG. 3, if, at step 214, it is determined that flame is not reestablished and thus there is a continued loss of flame in the boiler, then the method 200 includes having the controller implement a second stage sequence in response to the detecting the continued loss of flame, as shown in FIG. 5. In accordance with one embodiment, the second stage sequence can be implemented once a flame is not established after a predetermined amount of time, e.g., 1 minute, after the first stage event is implemented. The predetermined amount of time may vary. The baghouse 110 remains in the bypass position, as shown in FIG. 6, with ID fan 112 at its reduced speed. Optionally, the method includes activating or triggering an alarm to indicate the determined continued loss of flame in the boiler at 222. The alarm can be an audible and/or visual alarm. In an embodiment, the optional alarm is used to annunciate the initiation of the second stage sequence.

The second stage sequence includes limiting the input feed received by the gasifier 104, shown at 224, and holding the decreased speed of the induced draft fan for a predetermined amount of time, as shown at 226, to purge the power plant system 100 of exhaust gas from the boiler 106. This can include controlling stack O2 controllers, for example. Also, for example, in accordance with an embodiment, the receipt of biomass (e.g., wood) from the fuel feed system 102 and oxygen/air typically fed to the gasifier 104 is limited. The oxygen/air control valve associated with the gasifier 104 can automatically move to a manual mode and an 0% feed position (limiting all combustion air to the burner, and no air under grates) (or approximately 0%), thus locking out input.

In an embodiment, the ID fan 112 speed is held at its last speed before the second stage sequence was initiated. The speed of the ID fan 112 can be held for a predetermined amount of time, e.g., approximately five minutes, to purge the system 100. In one embodiment, an operator can decrease the ID fan speed 112 from its current speed at the control panel, but not increase it. In an embodiment, the highest speed for ID fan 112 is approximately 50% (half of 100% fan speed).

A timer is started at 228 indicating a time remaining before the system (e.g., controls) can be reset. In accordance with one embodiment, the predetermined period of time is at least approximately 5 minutes. The timer can be associated with a display on the control system, for example, indicating the time remaining until the baghouse 110 and its systems can be reset. This timer can be viewed on the exemplary screen shot of FIG. 8, for example, labeled as 2nd STAGE FLAME LOSS LOCKOUT TIMER. In an embodiment, an indicator is associated with the timer to indicate its status. For example, the indicator may display red when counting down the predetermined (e.g., 5 minute) lockout period, and green when the period is complete.

After the timer is complete, the system is reset, as shown at 230. For example, as understood by one of ordinary skill in the art, the system can be reset by pushing a SYSTEM STOP and then SYSTEM START control keys, and/or a RESET button on an operator control panel. This will allow the operator to resume control of the ID Fan 112, valves, and fuel feed system 102 in order to relight the burner of the boiler 106 and thus reignite the flame 124.

After relighting the boiler, the flame is detected at step 232. At 234, a timer is started. The timer is used to determine if the flame is detected for a predetermined amount of time, e.g., approximately 5 minutes. In one embodiment, the control logic shown in FIGS. 4 and 5 is not activated by the controller until a temperature reading of the flame 124 from the measurement device 126 is maintained above a predetermined temperature for a predetermined amount of time. In an embodiment, the flame temperature is established and maintained >1900 degrees F. (or another determined set temperature that indicates a flame is established) for approximately 5 consecutive minutes (or another predetermined amount of time) before the controller implements first and/or second stage sequences. The intent is to provide an operator with sufficient time to establish a flame in the burner of the boiler 106 during startup, without loss of flame trip actions hindering a successful startup. The timer can be associated with a display on the control system, for example, indicating the time remaining until the bypass period is complete. This timer can be viewed on the exemplary screen shot of FIG. 8, for example, labeled as STARTUP FLAME LOSS TRIP BYPASS. In an embodiment, an indicator is associated with the timer to indicate its status. For example, the indicator may display red when counting down the trip bypass period (e.g., 5 minute), and green when the period is complete.

At 236, after the timer is complete, it is determined if the flame is maintained in the boiler 106. If YES, then, as shown in FIG. 2, the system 100 is placed in normal operation at 202 (see FIG. 2) and its systems monitored at 204. The system 100 can be placed automatically into normal operation after a flame is positively determined as being maintained during the time period in accordance with an embodiment.

During or after implementation of the above steps, e.g., after reset, an operator may optionally intervene and take action with regards to the system. For example, when the STARTUP FLAME LOSS TRIP BYPASS system is activated, the operator can ensure relighting of the boiler and that all systems (e.g., baghouse 110 and induced draft fan 112) are running under normal settings. Further, the operator may initiate a purge of the system, and/or implement further testing of the system before normal operation is resumed.

It should be noted that the above described steps of the first and second stage sequences of FIG. 4 and FIG. 5 are not limited to those described. Additional actions may be implemented to limit injury or damage and increase safety of the power plant system when flame out detection occurs.

In addition to the above described method and implementation used as control logic, it should be understood by one of ordinary skill in the art that additional control methods and/or logic can be used with power plant system 100, and/or implemented during the methods disclosed herein. For example, any emergency stops and/or emergency trip initiations (e.g., pushing of a stop button, low water readings, etc.) associated with the power plant system 100, as generally known in the art, can be activated and implement control independently from the herein described flame loss control logic of method 200. Such emergency sequences can be configured to automatically override the ID fan speed and bypass of the baghouse 110, for example.

In accordance with an embodiment, a bypass push button is associated with the controller and/or provided on a control panel associated with the power plant system 100. The bypass push button can be used to implement maintenance and/or testing of the temperature measurement device 126, if necessary. Activation or pushing the bypass push button allows the device 126 to be removed from service without initiating the control logic of the first stage and/or second stage sequences of the herein disclosed method. In one embodiment, the bypass button must be maintained in its bypass position to bypass the trip logic. In another embodiment, if the flame temperature is <1400 degrees F. (or another predetermined temperature used to detect flame loss), and the bypass button is not held in, the flame loss trip logic of method 200 is initiated.

In one embodiment, an operator is positioned at the control panel to observe process conditions when the bypass push button is pushed. The operator can be prepared to take any action needed to secure the plant while the flame loss trip bypass is activated. A second operator may optionally perform maintenance on the measurement device 126.

The reasons for loss of flame in the boiler are not limiting. Accordingly, the herein described method 200 can be implemented in combination with additional control logic and method steps associated with the power plant system 100 for taking corrective action with regards to one or more devices in the power plant system 100 and relighting the burner of the boiler 106. The first and/or second stage sequences described herein are dependent upon the status of the flame and activated upon loss of flame. Accordingly, the method 200 can be configured for implementation as designed whenever flame is lost for any number of reasons. For example, it is generally known to include high pressure hold control logic in a system like power plant system 100. When such high pressure hold control logic is initiated, the flame 124 of boiler 106 can be lost. Accordingly, at least the first stage sequence of the herein disclosed method 200 can be initiated.

Also, an emergency trip logic sequence can be input under any number of conditions, including, local (control panel) or remote (plant) emergency stop switch being pushed, a High Pressure Steam switch associated with the boiler is activated, a Low Water Cut Out switch associated with the boiler is activated, an Auxiliary Low Water Cut Out switch associated with the boiler is activated, and/or the ID Fan 112 is not running, for example. Such parts, switches, sensors, etc. and their control methods within a power plant system are generally understood by one of ordinary skill in the art and are, therefore, not described in detail herein. When any of these or other emergency trip inputs activate, in accordance with one embodiment, the following will occur: System run toggles to system stop; damper power is lost, causing the total air valve and the O2 valve to fail in their positions resulting from their spring loading (total air valve will close, O2 valve move to 0% (all air to burner, no air under grates)) (or approximately 0%), the fuel feed system 102 stops its feed to gasifier 104, the ID Fan 112 speed will decrease to approximately 10% (or another predetermined speed), and the baghouse 110 is bypassed.

Further, in accordance with embodiments, other conditions may implement the above-described baghouse bypass logic sequence in the power plant system 100 including, but not limited to: pushing the bag house bypass button on control room operator panel, detecting baghouse inlet temperature >375 degrees F., emergency stop push button activated (via control panel or remote), baghouse internal temperature (TT-715) >400 degrees F., and activation of boiler flame loss logic (i.e., method 200). However, such examples are not intended to be limiting.

In an embodiment, a water quench/deluge system is provided with the fuel feed system 102 for use upon high temperature detection.

Testing of the emergency trip and safety systems can be routine.

Accordingly, this disclosure provides a method relating to controlling, in stages, different parts of a biomass power plant (e.g., induced draft fan, biomass feed) when flame loss of a boiler in such a system is detected. The implementation of the herein described stage control sequence after flame loss detection of a boiler associated with a gasifier provides a safety feature in a biomass power plant by substantially reducing and/or substantially eliminating problems and potential damage to the system and/or housing it is contained in when the boiler flame is lost.

Other embodiments include incorporating the above method steps in FIGS. 2-4 into a set of computer executable instructions readable by a computer and stored on a data carrier or otherwise a computer readable medium, such that the method 200 is automated. The steps can be programmed into existing systems to automatically perform the disclosed method 200 and its sequences. In a possible embodiment, the method may be incorporated into an operative set of processor executable instructions configured for execution by at least one processor and/or controller. FIGS, 2, 3, and 4 each show a flow chart of such computer readable instructions. For example, in some embodiments, a memory or storage associated with the electronics of the power plant system 100 carries instructions configured such that when the executable instructions are executed by a computer or processor, they cause a computer or processor to automatically perform a method for controlling operation of a power plant system. In alternative embodiments, hard-wired circuitry may be used in place of or in combination with software instructions to implement the disclosure. Thus, embodiments of this disclosure are not limited to any specific combination of hardware circuitry and software. Any type of computer program product or medium may be used for providing instructions, storing data, message packets, or other machine readable information associated with the method 200. The computer readable medium, for example, may include non-volatile memory, such as a floppy, ROM, flash memory, disk memory, CD-ROM, and other permanent storage devices useful, for example, for transporting information, such as data and computer instructions. In any case, the medium or product should not be limiting.

The system may have a computer system which includes a bus or other communication mechanism for communicating information, and one or more of its processing elements may be coupled with the bus for processing information. Also, the memory may comprise random access memory (RAM) or other dynamic storage devices and may also be coupled to the bus as storage for the executable instructions. Storage devices may include read only memory (ROM) or other static storage device coupled to the bus to store executable instructions for the processor or computer. Alternatively, another storage device, such as a magnetic disk or optical disk, may also be coupled to the bus for storing information and instructions. Such devices are not meant to be limiting.

While the principles of the disclosure have been made clear in the illustrative embodiments set forth above, it will be apparent to those skilled in the art that various modifications may be made to the structure, arrangement, proportion, elements, materials, and components used in the practice of the disclosure.

It will thus be seen that the features of this disclosure have been fully and effectively accomplished. It will be realized, however, that the foregoing preferred specific embodiments have been shown and described for the purpose of illustrating the functional and structural principles of this disclosure and are subject to change without departure from such principles. Therefore, this disclosure includes all modifications encompassed within the spirit and scope of the following claims.

What is claimed is:

1. A method for controlling operation of a power plant system, the power plant system comprising at least a gasifier, a boiler, an induced draft fan, and a baghouse; the gasifier configured to receive input feed including biomass as fuel to produce exhaust gas; the boiler having a flame for igniting the exhaust gas received from the gasifier and for providing power, and a measurement device associated therewith configured to measure a temperature of the flame of the boiler and to determine loss of flame based on the temperature; the baghouse configured to receive exhaust gas from at least the boiler to remove particulates therefrom; and the induced draft fan configured to control the production rate of energy and to run at a predetermined speed to draw filtered exhaust gas from the baghouse for output via an exhaust system; and a controller in communication with the power plant system configured to implement the method after detecting loss of flame in the boiler using the measurement device, the method comprising:

implementing a first stage sequence in response to the detecting the loss of flame in the boiler comprising:

automatically bypassing the baghouse;

automatically decreasing the speed of the induced draft fan; and determining if the flame of the boiler is reestablished.

2. The method according to claim 1, further comprising triggering an alarm to indicate the detecting the loss of flame in the boiler.

3. The method according to claim 1, wherein the automatically bypassing the baghouse comprises limiting its input from at least the boiler and its output via the induced draft fan such that the induced draft fan is configured to draw flue gas from at least the boiler and purge the power plant system.

4. The method according to claim 1, wherein the decreasing the speed of the induced draft fan is performed for a predetermined period of time.

5. The method according to claim 1, wherein, if the determining determines that the flame of the boiler is reestablished, the method further comprises: removing the bypass of the baghouse;

else, if the determining determines a continued loss of flame in the boiler, the method further comprises:

implementing a second stage sequence in response to the detecting the continued loss of flame comprising:

limiting the input feed received by the gasifier;

holding the decreased speed of the induced draft fan for a predetermined amount of time.

6. The method according to claim 5, further comprising triggering the alarm to indicate the determined continued loss of flame in the boiler.

7. The method according to claim 5, further comprising resetting the power plant system after the predetermined amount of time.

8. The method according to claim 5, wherein the limiting the input feed received by the gasifier comprises limiting receipt of biomass and oxygen fed to the gasifier.

9. The method according to claim 7, further comprising: relighting the boiler, and establishing a timer to detect the flame for a predetermined amount of time.

10. A power plant system comprising:

a gasifier configured to receive input feed including biomass as fuel to produce exhaust gas;

a boiler having a flame for igniting the exhaust gas received from the gasifier and for providing power;

a measurement device associated therewith configured to measure a temperature of the flame of the boiler and to determine loss of flame based on the temperature;

a baghouse configured to receive exhaust gas from at least the boiler to remove particulates therefrom;

an induced draft fan configured to run at a predetermined speed to draw filtered exhaust gas from the baghouse for output via an exhaust system, and a controller in communication with the power plant system, wherein after detecting loss of flame in the boiler using the measurement device, the controller is configured to automatically bypass the baghouse and automatically decrease the speed of the induced draft fan.

* * * * *